US005297505A

United States Patent [19]

Doll et al.

[11] Patent Number: 5,297,505

[45] Date of Patent: Mar. 29, 1994

[54] INTERNAL COMBUSTION ENGINE VALVE ACTUATOR

[75] Inventors: Gerhard Doll, Stuttgart; Jürgen Frey, Esslingen, both of Fed. Rep. of Germany

[73] Assignee: Mercedes-Benz AG, Fed. Rep. of Germany

[21] Appl. No.: 82,857

[22] Filed: Jun. 28, 1993

[30] Foreign Application Priority Data

Jun. 27, 1992 [DE] Fed. Rep. of Germany ..... 4221134

[51] Int. Cl.[5] ..... F01L 1/34; F01L 1/12

[52] U.S. Cl. ..... 123/90.16; 123/90.17

[58] Field of Search ..... 123/90.15, 90.16, 90.17, 123/90.6

[56] References Cited

U.S. PATENT DOCUMENTS 4,726,332 2/1988 Nishimura ..... 123/90.16
4,901,685 2/1990 Fukuo et al. ..... 123/90.16
4,911,112 3/1990 Oikawa et al. ..... 123/90.16
4,926,804 5/1990 Fukuo ..... 123/90.16
4,942,854 7/1990 Shirai et al. ..... 123/90.17
4,995,353 2/1991 Stegeman et al. ..... 123/90.6

FOREIGN PATENT DOCUMENTS 2185784 7/1987 United Kingdom .

*Primary Examiner*—E. Rollins Cross
*Assistant Examiner*—Weilun Lo
*Attorney, Agent, or Firm*—Evenson, McKeown, Edwards, Lenahan

[57] ABSTRACT

A valve actuation appliance for an internal combustion engine having an actuation lever and a coupling lever which can be coupled thereto. The levers are driven by different cams. In order to prevent coupling of the two levers in a region relative to the camshaft position, particularly when it is not certain that the coupling procedure will be concluded without interruption, it is proposed that the base circle of one of the two cams be lowered in that region by a slight amount relative to the rest of the base circle.

11 Claims, 3 Drawing Sheets

INTERNAL COMBUSTION ENGINE VALVE ACTUATOR

BACKGROUND AND SUMMARY OF THE INVENTION

The present invention relates to a valve actuator in an internal combustion engine, and, more particularly, to an appliance for valve actuation in an internal combustion engine, comprising a camshaft with at least one first cam and at least one second cam, an actuation lever driving a valve and driven by the first cam having a cam protrusion and a base circle, a coupling lever driven by the second cam having a cam protrusion and a base circle, the actuator lever and coupling lever being operatively supported on a lever pin so as to be pivotable relative to one another, a coupling appliance including a coupling element for coupling the actuator lever and the coupling lever, which coupling element is attached to one of the levers and is configured to act on the other lever with adjustment thereof via a force change, and, a device for preventing adjustment of the coupling element at one of a time and in a period predetermined by the position of the camshaft, including a change in force acting on the coupling element.

A valve actuator appliance is described in DE 34 45 951 C2 wherein an adjustment of the coupling element at an undesired time is prevented by an additional mechanical control lever which engages in the coupling element. This arrangement is expensive, subject to wear, heavy and requires additional installation space.

An object of the present invention is to provide a valve actuating appliance which prevents coupling of the actuation lever and the coupling lever at an undesired time or in an undesired period without involving substantial expenditure or additional weight and installation space.

This object has been achieved in a valve actuator appliance of the present invention by providing that the base circle of one of the two cams has a depression in the region in which the associated lever is in contact at the predetermined time or in the predetermined period.

In the device according to the invention, it is a particular advantage that neither additional weight nor additional installation space are introduced by the depression produced in a particular region of the base circle. Specifically, the depression in the base circle can have a circular configuration with a radius which is slightly smaller relative to the base circle. Low manufacturing costs result especially because the base circle depression does not have to have particularly accurate dimensions. The wear occurring during the slight additional motions is slight. Coupling between the two levers at an undesired time or in an undesired period is prevented in a simple manner in the present invention because, in contrast to the periods in which the two levers slide along on the base circle matched to one another, they are slightly pivoted relative to one another during the undesired periods and because, as a result, the coupling element attached to one lever cannot engage on the other lever. Undesired times and periods for the coupling of the two levers can occur because simultaneous coupling of a plurality of lever pairs has to be avoided or because a certain sequence has to be maintained in the coupling of the lever pairs or because it is necessary to prevent a small part only of the coupling procedure being carried out when the lever is loaded. As a result, wear and damage occur on the coupling appliance or, if the coupling is cancelled under load, on the lever and cam.

In one embodiment of the coupling element of the present invention, which can be actuated hydraulically or purely mechanically and which is easy to manufacture, the coupling is a preloaded pin guided on a lever and partially introducible into an opening in the other lever. The pin can be arranged in the actuation lever or in the coupling lever and the opening correspondingly in the other lever. It is also possible for the coupling procedure to be initiated by an increase or a reduction in the force acting on the pin.

The appliance according to the present invention, by the provision of a region of the base circle depression arranged immediately before the cam protrusion and extending to a crankshaft angle of about 90°, reliably prevents incomplete coupling of the actuation and coupling levers where this cannot be brought to a conclusion reliably because the cam protrusion subsequently becomes effective and force is transmitted between the two levers. A coupling introduced shortly before the region of the reduced base circle radius can be reliably concluded because the forces transmitted between the two levers in this region are, at most, slight.

According to another feature of the present invention, apparatus is provided for effecting the change in force within a second region of substantially less than 360° of camshaft angle, which region remains constant with respect to position of the camshaft, a plurality of second cams is provided for actuating valves and have mutually offset cam protrusions, and the depression is arranged only in those of the second cams in which the second region overlaps with the time or period of undesired adjustment of the coupling element. The beginning of coupling is always located within a certain period so that, in the case of those cams for which the undesired time or period falls completely outside the first mentioned period, it is possible to economize by omitting the measure of reducing the base circle radius. Apparatus for fixing the time when coupling begins, which can be manufactured with little outlay and are easy to operate, include a switching valve inserted into a liquid conduit between a pressure source and the coupling element.

A favorable range for the depth of the base circle reduction is in the range of approximately 0.1 to 0.5 mm. On one hand, this depth reliably avoids coupling and, on the other, avoids an excessively strong deflection of the associated lever.

In an embodiment of the appliance in accordance with the present invention in which the base circle depression is arranged on the cam associated with the coupling lever, the reduction in the base circle radius has no influence whatsoever on the position of the associated valve or on the forces acting on the latter because, in the decoupled condition, there is no connection between the coupling lever and the valve and, in the coupled position, the position of the levers is determined by the cam with the unaltered base circle associated with the actuation lever. If a hydraulic valve clearance compensation element is associated, as usual, with the actuation lever, the arrangement avoids pumping up this element erroneously.

BRIEF DESCRIPTION OF THE DRAWINGS

These and other objects, features and advantages of the present invention will become more apparent from the following detailed description thereof.

DETAILED DESCRIPTION OF THE DRAWINGS

Figure 1:
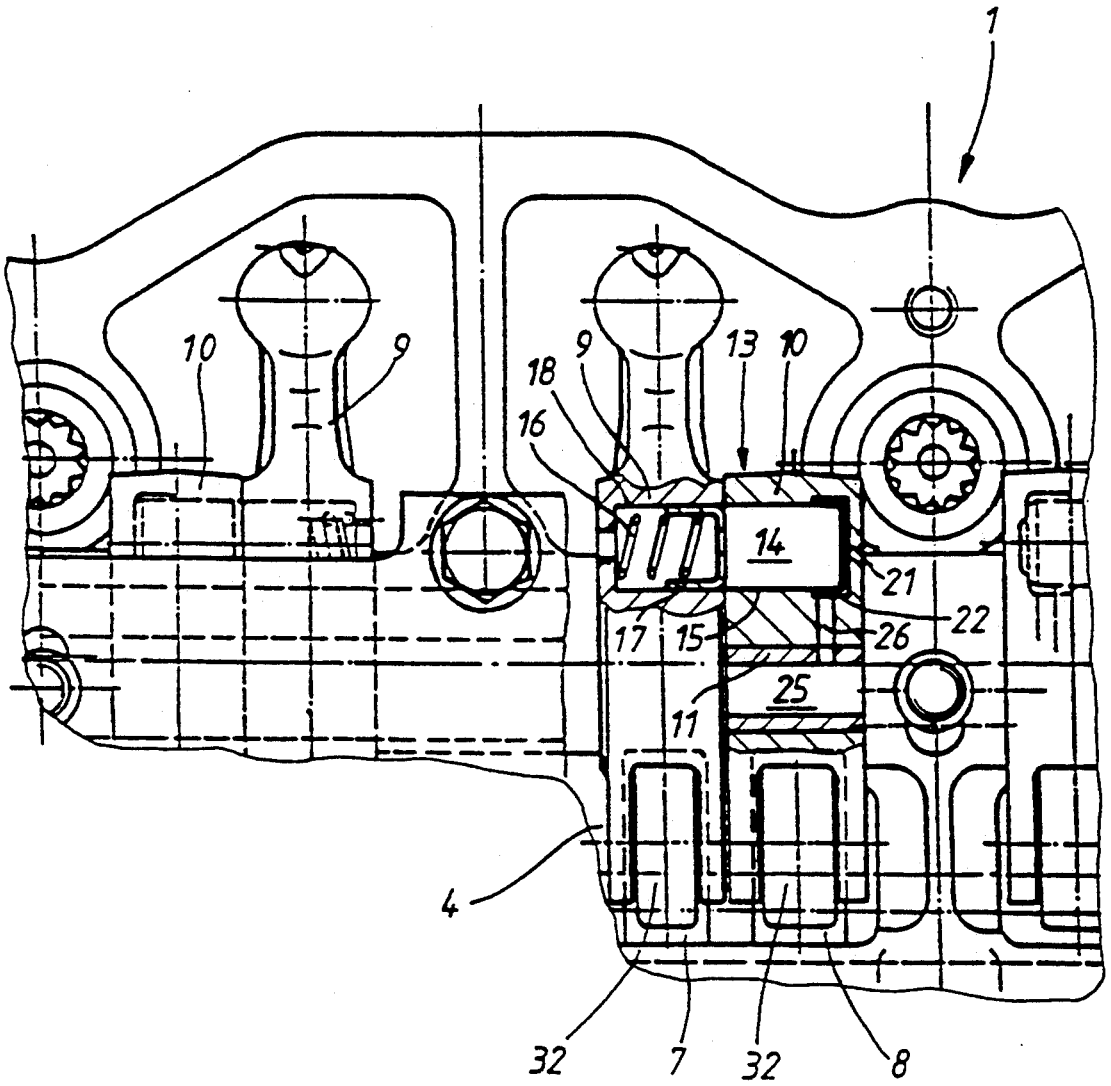
FIG. 1 is a partial cross-sectional, plan view of a multi-cylinder internal combustion engine with actuation levers and coupling levers for the valve drive, in accordance with the present invention.
Figure 2:
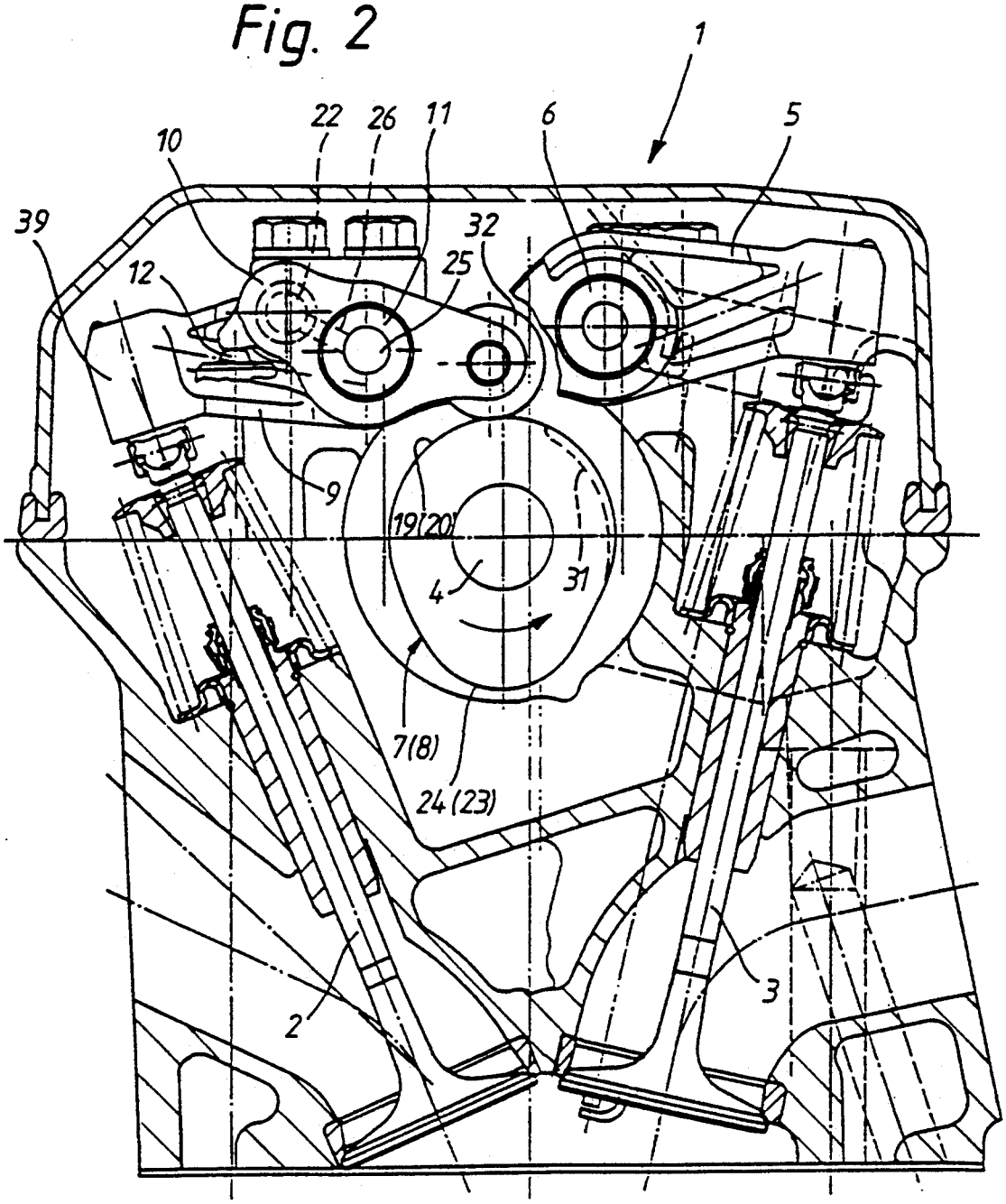
FIG. 2 is a partial cross-sectional elevation view of a cylinder head of the internal combustion engine shown in FIG. 1.

Two inlet poppet valves 2 and two exhaust poppet valves 3 are supported per cylinder in the cylinder head 1 of a multi-cylinder reciprocating-piston internal combustion engine, a relevant portion of which is shown. The valves 2, 3 are driven by a camshaft 4 arranged therebetween. A rocker arm 5 with a rocker arm pin 6 is connected between the camshaft 4 and each exhaust valve 3. Two cams 7, 8 are associated with each inlet valve 2 on the camshaft 4. Cam 7 actuates an actuation lever 9 and is configured as a rocker arm which drives the inlet valve 2 directly. The other cam 8 actuates a coupling lever 10 which can be coupled to the actuation lever 9. The actuation lever 9 and the coupling lever 10 are rotatably supported on a common lever pin 11. A spring plate 12 ensures the contact of the coupling lever 10 on the cam 8 even in the condition when it is decoupled from the actuation lever 9.

The coupling between the actuation lever 9 and the coupling lever 10 takes place by way of a coupling device 13 which includes a pin 14 acting as the coupling element. The pin 14 is guided so that it can be displaced longitudinally in a hole or bore 15 parallel to the lever pin 11 in the coupling lever 10 and is loaded by a spring 16 via a guide cup 17 which is guided so that it can be displaced longitudinally in a hole 18 in the actuation lever 9. When the two levers 9, 10 are in contact on the respective base circle 19, 20 of the cams 7, 8, the hole 18 is aligned with the hole 15. In the decoupled condition, the spring 16 presses the pin 14 against a stop 21 at its end facing away from the actuation lever 9 so that it closes the contact plane between the two levers 9, 10 and does not protrude into the hole 18. In order to couple the two levers 9, 10, oil pressure is generated in a pressure space 22 at the end of the pin 14 facing away from the actuation lever 9; this oil pressure displaces the pin 14 partially into the hole 18 of the actuation lever 9 against the force of the spring 16 and thereby, couples the two levers 9, 10 torsionally to one another. Because the cam protrusion 23 of the cam 8 associated with the coupling lever 10 is larger than the cam protrusion 24 of the cam 7 associated with the actuation lever 9, the valve lift curve of the inlet valve 2 is now determined by the cam 8. Alternatively, the pin 14 can be arranged in the actuation lever 9, the spring 16 can be arranged in the coupling lever 10, coupling can be carried out by pressure relief in the pressure space 22 and decoupling can be effected by pressure build-up in the pressure space 22.

The build-up and reduction of pressure in the pressure space 22 takes place by a longitudinal hole 25 in the lever pin 11. The hole 25 is connected to the pressure space 22 via a transverse hole 26 in the coupling lever 10. As is shown in more detail in FIG. 5, the longitudinal hole 25 is supplied with oil via a conduit 28 from an oil pump 27. The oil can be the usual lubricating oil pump of the internal combustion engine. A fast-acting 3/2-way valve 29 is arranged in this conduit 28 and connects the longitudinal hole 25 either to the oil pump 27 or to a reservoir 30. The valve 29 can be controlled such that it is switched over within a certain period which always remains the same relative to the position of the camshaft.

If the pressure build-up in the pressure space 22 occurs a short time interval before the beginning of the actuation of the two levers 5, 6 by the cam protrusions 23, 24, the pin 14 will then have only traversed a part of its displacement into the hole 18. Because substantial forces are now transmitted between the two levers 9, 10, a further displacement of the pin 14 is impossible, so that the pin 14 and the hole 18 are loaded with large surface contact pressures or the pin 14 is ejected from the hole 18. Both are associated with substantial wear, so that the function of the coupling appliance can be impaired.

In order to reliably exclude such an unfavorable coupling of the two levers 9, 10, a depression 31 in the form of a groove-shaped recess is provided in the cam 8 associated with the coupling lever 10 in that part of the base circle 20 immediately preceding the cam protrusion 23. The width of the depression 31 must be at least equal to the width of the part of the coupling lever 10 sliding or rolling via roller 32 on the cam 8. The depth of the depression 31 is at least sufficiently large that the two levers 9, 10 are pivoted relative to one another to such an extent, and the two holes 15, 18 are therefore offset to one another to such an extent when the coupling lever 10 dips into the depression 31, that even partial insertion of the pin 14 into the hole 18 is impossible even when the pressure space 22 is subjected to pressure. Because coupling is also excluded when the two cam protrusions 23, 24 are effective, because of their different sizes, the coupling operation can only begin when the two equally large base circles 19, 20 are reached where it can be brought to a conclusion without difficulty because, in that region, the two holes 15, 18 are aligned with one another. A coupling procedure commenced shortly before the depression 31 is reached can be brought to a conclusion without difficulties when running over the depression 31 because no large forces are transmitted between the two levers 9, 10 in this region.

Figure 3:
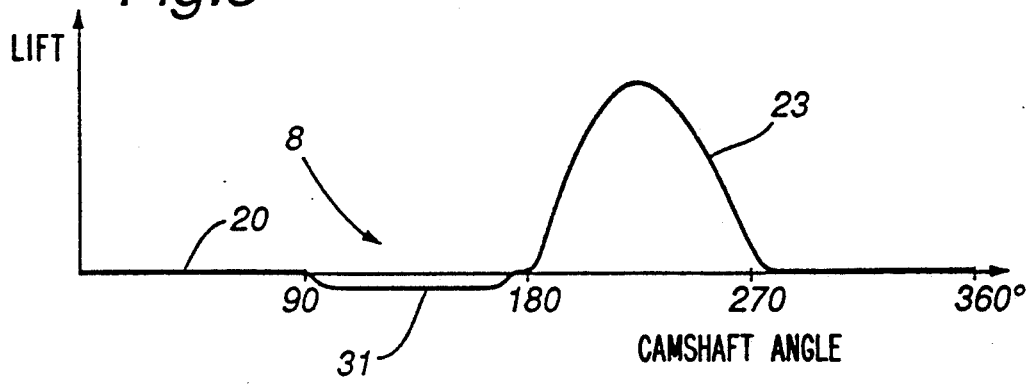
FIG. 3 is a development diagram of a cam with a reduction in the base circle radius in the region before the cam protrusion.

As illustrated in FIG. 3, it is particularly useful for the depression 31 to extend over approximately 90° of camshaft angle although precise maintenance of this length is not required. Particular importance should, however, be placed on a good, low-acceleration transition from the base circle 20 to the depression 31 and from the depression 31 to the cam protrusion 23. The latter transition must be kept sufficiently short for the beginning of coupling to be prevented but, it is also necessary to ensure that there is a good entry from the base circle 19, which is effective in the coupled condition.

Figure 4:
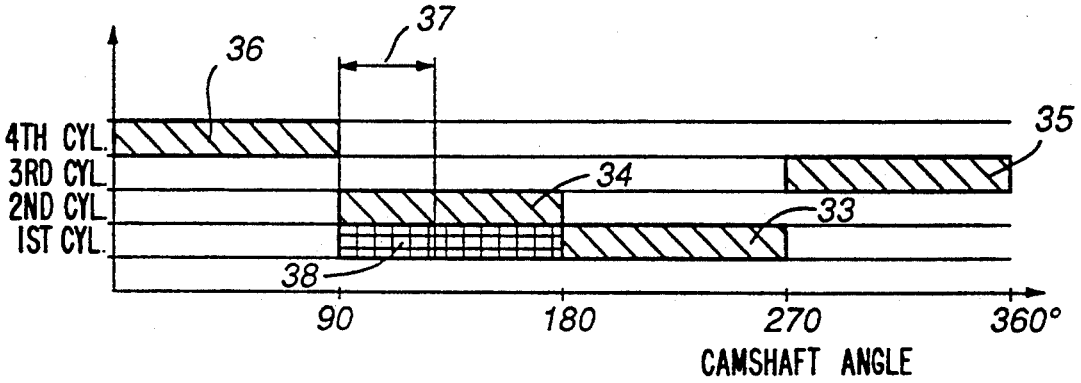
FIG. 4 is a diagram of an application of the present invention to a four-cylinder internal combustion engine.

FIG. 4 represents the periods 33 to 36 for the lift of the inlet valves in the individual cylinders in a four-cylinder internal combustion engine. Using a simplified assumption, these periods follow on from one another without gaps. In order to avoid a base circle depression on each cam associated with a coupling lever, the period 37 within which the beginning of the coupling procedure falls is limited to a certain range of the camshaft position. The relationship therebetween is fixed because the coupling procedure only takes place at a certain engine rotational speed of, for example, 3500 rpm.

Figure 5:
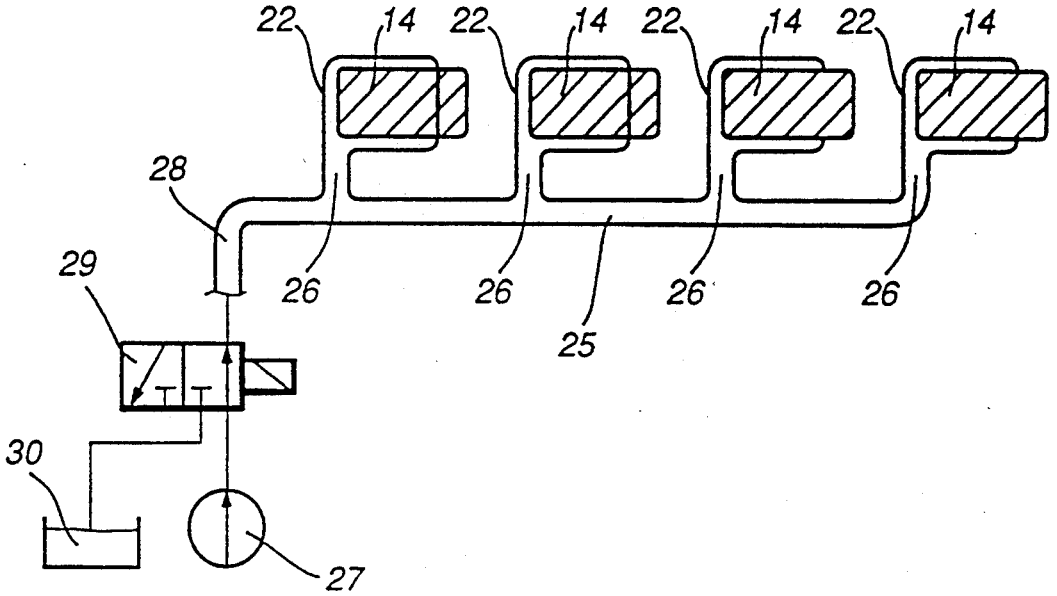
FIG. 5 is a schematic view of a control device for the application depicted in FIG. 4.

The period 37 can be fixed in a relatively simple manner by a corresponding time control of the valve 29 (FIG. 5). If, for a length of approximately 40° of camshaft angle, the period 37 is placed such that its beginning is 90° of the camshaft angle or somewhat less before the cam protrusion of the first cylinder, it is then sufficient to provide a base circle depression 31 on the cam 10 for this first cylinder in a region 38 which begins at least 90° of camshaft angle before the cam protrusion 23.

Coupling for this first cylinder can then only take place after the conclusion of the lifting of the valve. A base circle depression 31 is unnecessary for the cams 8 of the other cylinders because the period 37 for the second cylinder falls in the time 34 when the cam protrusion 23 is effective, whereas, in the case of the third and fourth cylinders, there is sufficient time remaining to conclude the coupling procedure before the cam protrusion.

It is within the scope of the present invention for the base circle depression 31 to be arranged on the cam 7 associated with the actuation lever 9, but an arrangement on the cam 8 associated with the coupling lever 10 is deemed more advantageous. This is particularly so if a hydraulic valve clearance compensation element 39 (FIG. 1) is provided on or in the actuation lever 9. The valve clearance compensation element 39 can be pumped up in the case of a depression motion of the actuation lever 9 so that jamming in the valve drive and undesired openings of the inlet valve 2 occur.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. An apparatus for valve actuation in an internal combustion engine, comprising a camshaft with at least one first cam and at least one second cam, an actuation lever driving a valve and driven by the first cam having a cam protrusion and a base circle, a coupling lever driven by the second cam having a cam protrusion and a base circle, the actuation lever and coupling lever being operatively supported on a lever pin so as to be pivotable relative to one another, a coupling device including a coupling element for coupling the actuation lever and the coupling lever, which coupling element is associated with one of the levers and is configured to engage the other lever with movement thereof via a force change, and, for preventing movement of the coupling element at a predetermined position of the camshaft inclusive of the force change acting on the coupling element, a depression is provided at the base circle of one of the two cams in a first region in which the associated one lever is in contact at the predetermined position of the camshaft.

2. The apparatus according to claim 1, wherein the coupling element is a preloaded pin guided in one of the levers and is operatively arranged to be partially introducible into an opening in the other of the levers and the change in the force acting on the coupling element occurs via one of a change in pressure in a liquid pressure space and a change in an action of a mechanical spring.

3. The apparatus according to claim 1, wherein the region of the depression is arranged immediately before the cam protrusion of the cam at which the depression is located and extends to a crankshaft angle of approximately 90°.

4. The apparatus according to claim 3, wherein the coupling element is a preloaded pin guided in one of the levers and is operatively arranged to be partially introducible into an opening in the other of the levers and the change in the force acting on the coupling element occurs via one of a change in pressure in a liquid pressure space and a change in an action of a mechanical spring.

5. The apparatus according to claim 1, wherein means is provided for effecting the change in force within a second region of substantially less than 360° of camshaft angle, which region remains constant with respect to position of the camshaft, a plurality of second cams is provided for actuating valves and have mutually offset cam protrusions, and the depression is arranged only in those of the second cams in which the second region overlaps with the time or period of undesired adjustment of the coupling element.

6. The apparatus according to claim 5, wherein the coupling element is a preloaded pin guided in one of the levers and is operatively arranged to be partially introducible into an opening in the other of the levers and the change in the force acting on the coupling element occurs via one of a change in pressure in a liquid pressure space and a change in an action of a mechanical spring.

7. The apparatus according to claim 5, wherein the region of the depression is arranged immediately before the cam protrusion of the cam at which the depression is located and extends to a crankshaft angle of approximately 90°.

8. The apparatus according to claim 7, wherein the coupling element is a preloaded pin guided in one of the levers and is operatively arranged to be partially introducible into an opening in the other of the levers and the change in the force acting on the coupling element occurs via one of a change in pressure in a liquid pressure space and a change in an action of a mechanical spring.

9. The apparatus according to claim 5, wherein the force-change effecting means include a switching valve operatively arranged in a liquid conduit between a pressure source and the coupling element, so as to free or shut off the liquid conduit as a function of the position of the camshaft.

10. The apparatus according to claim 1, wherein the depth of the depression is approximately 0.1 to 0.5 mm.

11. The apparatus according to claim 1, wherein the depression is arranged on the second cam.

* * * * *